United States Patent [19]

West

[11] Patent Number: 5,025,846

[45] **Date of Patent: * Jun. 25, 1991**

[54] HIGH SPEED FOLDING DOOR

[75] Inventor: Floyd D. West, Galena, Ill.

[73] Assignee: Frommelt Industries, Inc., Dubuque, Iowa

[ * ] Notice: The portion of the term of this patent subsequent to Dec. 19, 2006 has been disclaimed.

[21] Appl. No.: 351,166

[22] Filed: May 12, 1989

Related U.S. Application Data

[63] Continuation-in-part of Ser. No. 216,325, Jul. 7, 1988, Pat. No. 4,887,659.

[51] Int. Cl.[5] ..... E05D 15/26

[52] U.S. Cl. ..... 160/199; 160/229.1

[58] Field of Search ..... 160/199, 196.1, 228, 160/206, 332, 184, DIG. 7, 135, 229.1; 52/406; 24/115 F, 306, 300, 301, 302

[56] References Cited

U.S. PATENT DOCUMENTS

| | | |
|---|---|---|
| Re. 14,893 | 6/1920 | Piper . |
| Re. 29,308 | 7/1977 | Dagenais . |
| 687,035 | 11/1901 | Kinnear . |
| 974,699 | 11/1910 | Ogden . |
| 1,069,505 | 8/1913 | Wheatley . |
| 1,162,231 | 11/1915 | Fritz . |
| 1,420,087 | 6/1922 | Frantz . |
| 1,581,854 | 4/1926 | May . |
| 1,758,600 | 5/1930 | Grassi . |
| 1,783,378 | 12/1930 | Ferris . |
| 1,949,224 | 2/1934 | Toelle . |
| 1,963,321 | 6/1934 | Yowell . |
| 1,986,178 | 1/1935 | Ainsworth . |
| 2,514,370 | 7/1950 | Bunnell . |
| 2,538,429 | 1/1951 | Schantz . |
| 2,839,135 | 6/1958 | Anderson . |
| 2,895,728 | 7/1959 | Edelman . |
| 3,003,551 | 10/1961 | Ferris . |
| 3,033,283 | 5/1962 | Jorgensen . |
| 3,040,806 | 6/1962 | Merrill et al. . |
| 3,229,751 | 1/1966 | Moorer . |
| 3,234,996 | 2/1966 | King et al. . |
| 3,272,257 | 9/1966 | Dirubbo . |
| 3,277,952 | 10/1966 | Tsuhako . |
| 3,373,791 | 3/1968 | Milani . |
| 3,494,407 | 2/1970 | Hollands et al. . |
| 3,516,473 | 6/1970 | Rosenquist . |
| 3,614,975 | 10/1971 | Aymond . |
| 3,693,694 | 9/1972 | Elhen . |
| 3,809,144 | 5/1974 | Garufo ..... 160/184 |
| 4,106,544 | 8/1978 | Dixon et al. . |
| 4,274,467 | 6/1981 | Comeau . |
| 4,289,190 | 9/1981 | Catan . |
| 4,380,260 | 4/1983 | Labelle . |
| 4,383,569 | 5/1983 | Labelle . |
| 4,387,760 | 6/1983 | Greschbach . |

(List continued on next page.)

*Primary Examiner*—Blair M. Johnson

*Attorney, Agent, or Firm*—Emrich & Dithmar

[57] ABSTRACT

A multi-section folding door includes first and second sets of vertically aligned panels with the panels in each set coupled together in an edge overlapping manner. Each of the panels is suspended from a support bracket attached to the panel's upper edge, with each of the brackets coupled to and suspended from a track by means of a respective trolley. A drive arrangement displaces the trolleys permitting the first and second sets of panels to be displaced toward or away from each other in closing or opening the folding door relative to an opening in a wall. Attached to an upper edge of each panel is an elongated flexible loop which is inserted in a lower slot of a respective support bracket along the length thereof. An elongated cord comprised of a hard material is inserted in the loop and positioned along the length thereof to maintain the loop securely coupled to and suspended from the support bracket. Breakaway coupling is provided along the full length of the overlapping edges of adjacent panels while the outer edges of the two end panels are each coupled in a sealed manner to a respective side frame. A sweeper strip extends from the lower edge of the panel and engages the floor to form a seal therewith. Each panel preferably includes an intermediate insulating layer, with the folding door

U.S. PATENT DOCUMENTS 4,427,049 1/1984 Belanger et al. .
4,432,406 2/1984 Belanger et al. .
4,497,357 2/1985 Labelle .
4,535,828 8/1985 Brockhaus ..... 160/DIG. 7 X
4,574,862 3/1986 Rejc .
4,722,146 2/1988 Kemeny ..... 160/135 X
4,825,089 4/1989 Lindsay ..... 52/406 X
4,855,567 8/1989 Mueller .
4,874,028 10/1989 Lynch et al. ..... 160/332
4,878,532 11/1989 Strelnieks ..... 160/332
4,887,659 12/1989 West ..... 160/199

FIG. 6
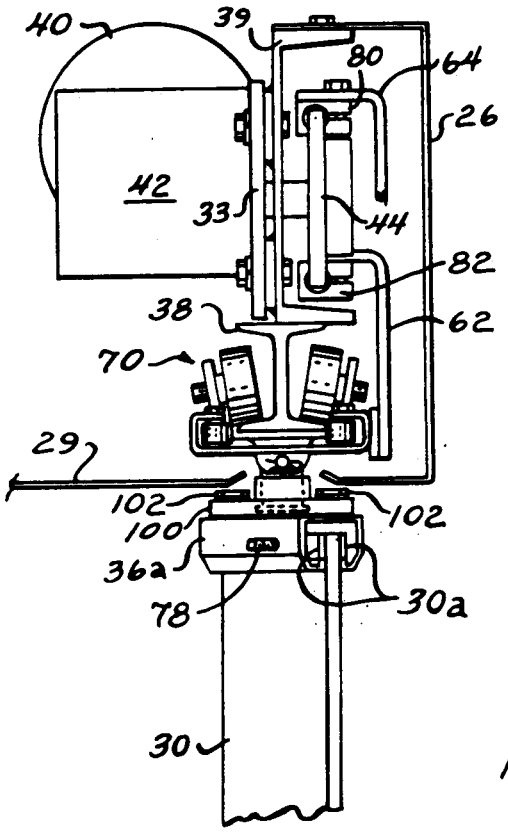
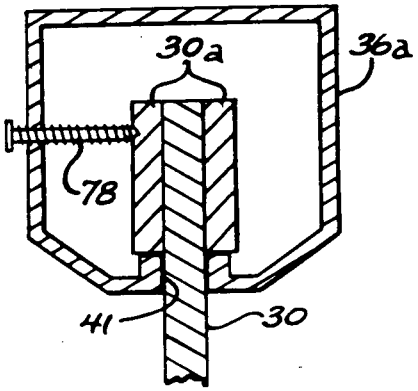
FIG. 7
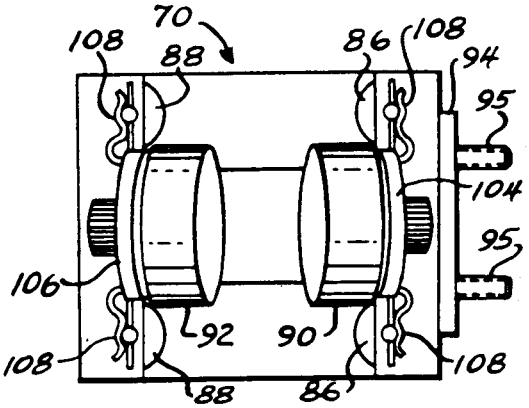
FIG. 8
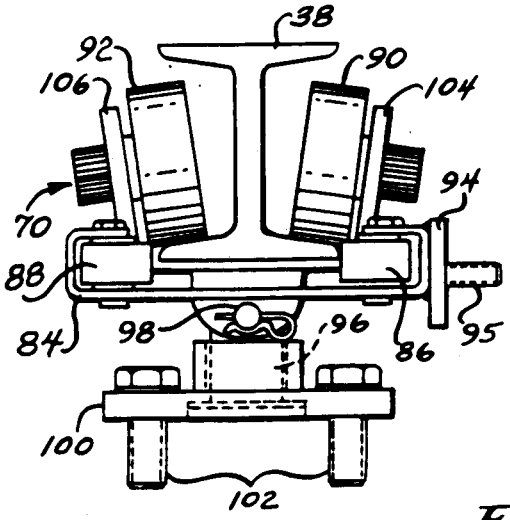
FIG. 9
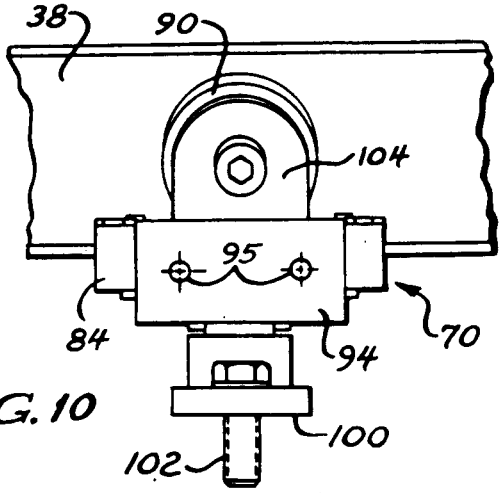
FIG. 10

HIGH SPEED FOLDING DOOR

BACKGROUND OF THE INVENTION

This application is a continuation-in-part of application Ser. No. 216,325, filed July 7, 1988, now U.S. Pat. No. 4,887,659, issued Dec. 19, 1984 entitled "High Speed Folding Door."

This invention relates generally to folding doors and partitions and is particularly directed to a multi-section, high speed, motor driven, impact-resistant folding door.

Electrically operated folding partitions, or doors, having a plurality of vertically oriented panels are commonly used in doorways to provide isolation between two rooms or between the outside and inside of a building. Such folding partitions are also frequently used to divide off two or more areas of a given room. The vertically oriented panels are typically suspended from a longitudinal, horizontal track along which the panels are movable. The panels may be coupled together in an accordion-like manner or they may be detached from one another such as in a strip door. Where the panels are coupled together, they are automatically positioned in a straight line, flat arrangement when in the fully closed position and are automatically moved to a folded, stacked configuration when in the fully open position. Such structures are often referred to as operable walls in that they provide a movable wall section for space isolation purposes.

Although not intended to afford high impact resistance, the individual panels of these folding door, or moving wall, arrangements are sometimes struck by a vehicle when in the closed position or when moving between the closed and the open positions. Such panel impact frequently causes the panel support mechanism, i.e., a movable trolley, to come off its support track preventing further displacement of the panels. High winds resulting in excessive displacement of the panels may also give rise to trolley binding on the support track. Misalignment between the trolleys and the support track must be corrected by proper repositioning of the trolleys before the panels can again be moved to either the open or closed position. Impact with a panel also frequently results in panel damage requiring its replacement. Panel replacement is expensive and time consuming, typically requiring removal of a mounting assembly which includes several brackets and nut and bolt combinations. In addition, adjacent suspended panels are coupled together in a flexible manner by ropes or straps which prevent separation of adjacent panels. However, impact of the panels with a vehicle generally results in severance of the rope, which must then be replaced, as well as damage to the adjacent panels which also frequently must be replaced. Moreover, such nonseparable coupling arrangements prevent manual pivoting displacement of the individual door panels so as to allow for transit through an aperture spanned by the door when power is lost. Finally, in order to prevent trolley misalignment and panel separation from its trolley-coupled mounting arrangement, particularly where the panels are subject to vehicular impact as well as to a wide range of environmental conditions, existing trolley and panel support installations are overly complex, expensive and difficult to install and maintain.

The present invention is intended to overcome the aforementioned limitations of the prior art by providing a multi-panel, high speed folding door having an inexpensive panel suspension arrangement which facilitates individual panel installation, removal and replacement; breakaway coupling between adjacent panels to reduce the possibility of impact damage to the panels; and insulated panels provided with top, bottom and side seals which are particularly adapted for use in low temperature environments such as in freezers.

OBJECTS AND SUMMARY OF THE INVENTION

Accordingly, it is an object of the present invention to provide an improved multi-section folding door.

It is another object of the present invention to increase the reliability and reduce the cost of multi-section, according-like folding doors.

Still another object of the present invention is to facilitate the mounting as well as to reduce the cost of installing individual panels in a multi-section folding door.

A further object of the present invention is to increase the impact resistance of a high speed, motor driven, multi-panel folding door.

A still further object of the present invention is to provide secure coupling between adjacent panels in a multi-panel folding door while allowing adjacent panels to be easily disconnected, if desired.

Yet another object of the present invention is to provide a multi-section folding door particularly adapted for use in low temperature environments such as encountered in freezers.

Another object of the present invention is to provide an insulated panel having seals on its top, bottom and side edges for use in an impact resistant high speed folding door operating in a low temperature environment.

This invention contemplates a folding door comprising: first and second side frames disposed adjacent to respective lateral edges of an opening in a wall; a header assembly disposed adjacent to an upper edge of and extending across the aperture and coupled to respective upper portions of the first and second side frames; a support structure coupled to and disposed adjacent to the header assembly; a plurality of trolleys coupled to and suspended from the support structure; a plurality of support arms each coupled to and suspended from a respective trolley, wherein each of the support arms includes an elongated slot extending the length of the support arm along a lower portion thereof; a plurality of flexible panels each having an attachment lip extending the length of an upper edge thereof, wherein the attachment lip is adapted for insertion in and engagement by the slot of a respective support arm in coupling and suspending each of the flexible panels from a respective support arm; flexible coupling means for coupling adjacent panels to one another; and drive means coupled to the trolleys for linearly displacing the trolleys along the support structure in opening and closing the folding door.

BRIEF DESCRIPTION OF THE DRAWINGS

The appended claims set forth those novel features which characterize the invention. However, the invention itself, as well as further objects and advantages thereof, will best be understood by reference to the following detailed description of a preferred embodiment taken in conjunction with the accompanying drawings, where like reference characters identify like elements throughout the various figures, in which:

FIG. 6 is a sectional view of the trolley and curtain support portions of the folding door of the present invention;

FIG. 7 is a sectional view illustrating details of the manner in which the individual panels, or curtains, are positioned within and supported by a support bar, or arm;

FIG. 8 is a top plan view of a trolley which allows for horizontal movement of the individual panels of the folding door of the present invention;

FIG. 9 is a sectional view taken transverse to a folding door support beam as used in the present invention illustrating additional details of a trolley mounted to the support beam;

FIG. 10 is a lateral view of the trolley arrangement illustrated in FIG. 9;

DETAILED DESCRIPTION OF THE PREFERRED EMBODIMENT

Figure 1:
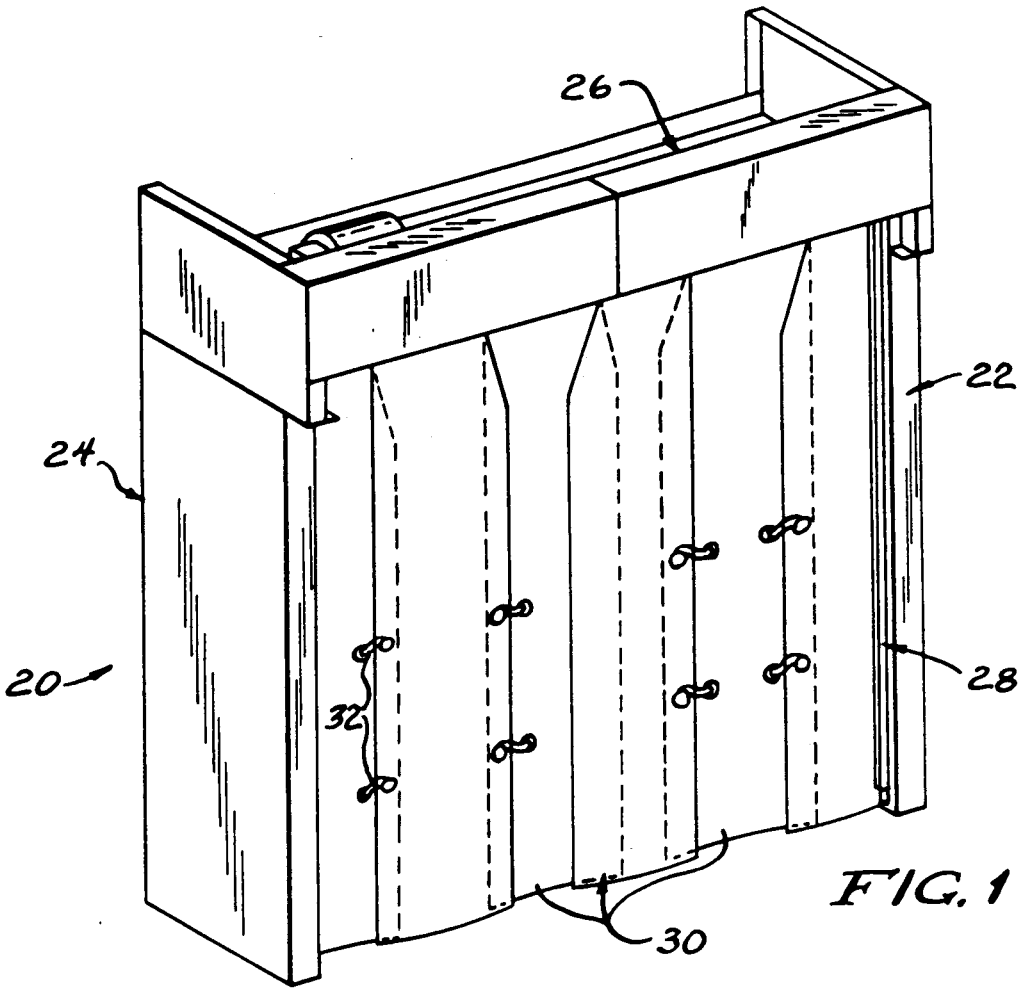
FIG. 1 is an upper, front perspective view of a folding door in accordance with the principles of the present invention.

Referring to FIG. 1, there is shown an upper, front perspective view of a high speed folding door 20 in accordance with the present invention. The folding door 20 includes right and left side frames 22, 24 as well as a header assembly 26. The header assembly 26 extends between and is coupled to respective upper end portions of the right and left side frames 22, 24. The header assembly 26 and side frames 22, 24 are typically disposed about or adjacent to an opening in a wall through which vehicles and workers pass. The header assembly 26 and side frames 22, 24 are preferably comprised of a high strength metal, but may also be fabricated from wood or plastic or other conventional construction materials which provide sufficient strength and rigidity to support the folding door and various components associated therewith. Suspended from the header assembly 26 are a plurality of vertically oriented panels 30 which are shown in the closed position in FIG. 1. When closed, the panels 30 are disposed in a generally planar array in an edge overlapping manner. As shown in FIG. 1, there are six panels 30 although the present invention is not limited to this specific number. In order to open the folding door 20, the panels 30 are first linearly displaced outwardly toward one of the side panels. Thus, three of the panels are drawn toward the right side frame 22, while the remaining three panels are drawn toward the left side frame 24 in opening the folding door. Each of the panels 30 is pivotally coupled to and suspended from a trolley mechanism (not shown in the figure) which is described in detail below. As the panels are drawn outwardly, they undergo rotational displacement so as to assume a stacked array of generally parallel panels. Adjacent panels 30 are coupled together by one or more breakaway retaining straps 32. A right stile 28 is coupled to the right side frame 22, while a left stile (which is not shown in FIG. 1) is coupled to and supported by the left side frame 24. Each of the stiles provides support for a panel support and displacement arrangement positioned within the header assembly 26 and described in detail in the following paragraphs.

Figure 3:
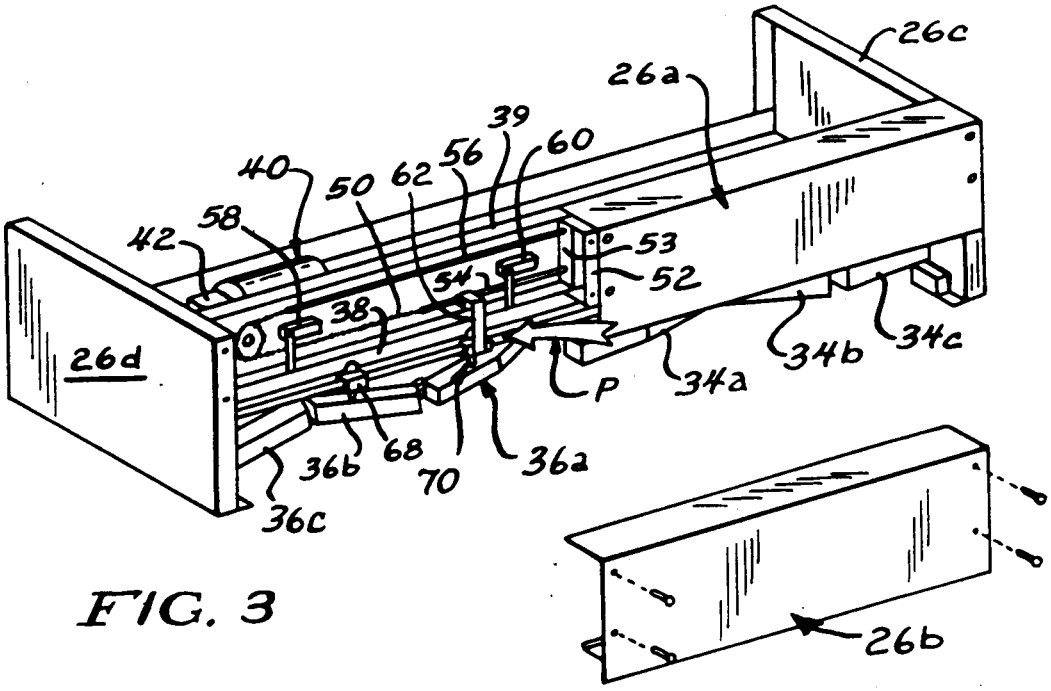
FIG. 3 is a perspective view of the header and support portion of the folding door illustrated in FIGS. 1 and 2.
Figure 2:
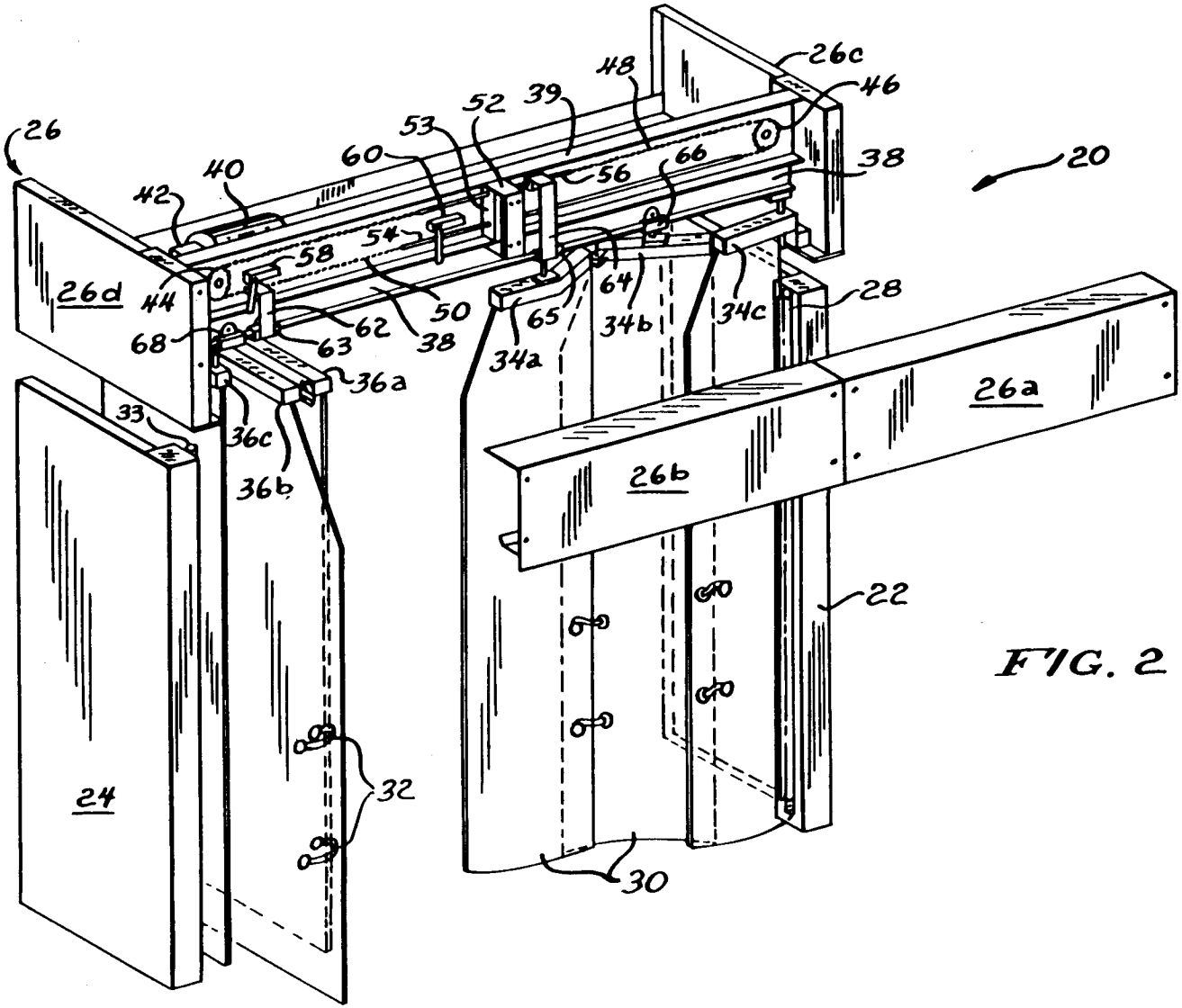
FIG. 2 is an upper perspective, exploded view of a folding door in accordance with the present invention.

Referring to FIG. 2, there is shown a partially exploded, upper perspective view of a folding door 20 in accordance with the present invention. FIG. 3 is a perspective view of an upper portion of the folding door illustrating details of the header assembly 26 and panel support and transport arrangement. The header assembly 26 includes right and left front sections 26*a* and 26*b* as well as right and left end sections 26*c* and 26*d*. The right and left end sections 26*c*, 26*d* are typically disposed within or adjacent to upper corners of an opening within a wall across which the folding door 20 spans. The right and left side frames 22, 24 are adapted for secure coupling at respective upper ends thereof to the right and left end sections 26*c*, 26*d* of the header assembly 26. Similarly, the right and left front sections 26*a*, 26*b* are adapted for secure attachment to forward edge portions of the right and left end sections 26*c*, 26*d* of the header assembly 26 as well as to the center bracket 52.

Disposed between and coupled to each of the right and left end sections 26*c*, 26*d* of the header assembly 26 are an upper support beam 39 and a lower I-beam 38. The upper support beam and the I-beam 38 may be coupled together by conventional means such as bolts, coupling brackets, or weldments. In addition, the support beam 39 and the I-beam 38 are securely coupled at respective ends thereof to the right and left end sections 26*c*, 26*d* of the header assembly 26.

Positioned aft of and adjacent to the support beam 39 is an electric drive motor 40. Coupled to the drive motor 40 is a gear box 42 which, in turn, is coupled by means of a drive shaft to a drive sprocket 44 which is positioned adjacent to and forward of the support beam 39. The shaft upon which the drive sprocket 44 is mounted extends through the support beam 39. Mounted to the other end of the support beam 39 in a freely rotatable manner by means of an idle shaft is an idle sprocket 46. Disposed about the drive and idle sprockets 44, 46 is the combination of a first chain 48, a second chain 50, a first drawbar 54, and a second drawbar 56. The first chain 48 is disposed about the idle sprocket 46 and is coupled at respective ends thereof to the first and second drawbars 54, 56. Similarly, the second chain 50 is disposed about the drive sprocket 44 and securely coupled at respective ends thereof to the first and second drawbars 54, 56. The combination of the aforementioned pairs of chains and drawbars forms an endless member which may be rotationally displaced by means of the drive motor 40 via the gear box 42 and drive sprocket 44. The first and second drawbars 54, 56 are inserted through and maintained in mutual alignment by a guide block 53. Guide block 53 includes a pair of apertures therein through each of which is inserted a respective one of the drawbars. Guide block 53 is securely maintained in a fixed position and is mounted to the support bar 39.

Coupled to the second drawbar 56 and disposed to the right of the center bracket 52 is a right moving bracket 64. Coupled to the first drawbar 54 and disposed to the left of the center bracket 52 is a left moving bracket 62. An upper end of the right moving bracket 64 is coupled to the second drawbar 56 while a lower end thereof is coupled to a trolley which engages a lower portion of the I-beam 38. Similarly, an upper end of the left moving bracket 62 is affixed to the first drawbar 54, while a trolley is attached to a lower end of the left moving bracket 62, with the trolley slidably engaging a lower portion of the I-beam 38. Each of the left and right moving brackets 62, 64 may be disconnected from its associated drawbar to permit the folding door to be opened manually without the aid of the drive motor 40. This is shown for the case of the left moving bracket 62 in FIG. 2, where the left moving bracket 62 has been disconnected from the first drawbar 54 and moved to the left adjacent to the second chain 50 where the three leftmost panels of the folding door have been manually moved to the open, or retracted, position. In order to manually open the left hand section of the door, a force must be applied as shown by the arrow designated by the letter "P" in FIG. 3. Alternatively, a trolley may be disconnected from its associated moving bracket to allow the folding door to be manually opened or closed.

Also mounted to the support beam 39 on a forward surface thereof and disposed between the drive and idle sprockets 44, 46 are open and close limit switches 58 and 60. Each of the limit switches 58, 60 is provided with a pivoting arm which is adapted for engagement by the left moving bracket 62 as the folding door 20 is closed and opened. The open limit switch 58 detects full leftward displacement of the left moving bracket 62 indicating that the folding door is in the full open position. Similarly, the close limit switch 60 detects full rightward displacement of the left moving bracket 62 indicating that the folding door 20 is in the fully closed position. Upon detection by the open limit switch 58 that the folding door is in the full open position and upon detection by the close limit switch 60 that the folding door is in the fully closed position, an appropriate signal is provided to the drive motor 40 to terminate further displacement of the folding door.

As stated above, attached to a lower portion of the left moving bracket 62 is a first trolley 63, while attached to a lower portion of the right moving bracket 64 is a second trolley 65. The first trolley 63 is coupled to and provides support for a left lead, or center, arm **36*a*. Similarly, the second trolley 65 is coupled to and provides support for a right lead, or center, arm 34*a*. Additional trolleys 66, 68 are also coupled to and suspended from the I-beam 38. In addition, the trolleys 66, 68 are coupled to and provide support for right and left intermediate arms 34*b* and 36*b*, respectively. Each of the aforementioned trolleys is adapted for sliding displacement along a lower portion of the I-beam 38 to allow the center and intermediate arms to be displaced toward and away from the center of the I-beam 38. A right end arm 34*c* is pivotally coupled to the right end section 26*c* of the header assembly 26, while a left end arm 36*c* is pivotally coupled to and supported by the left end section 26*d*. The right and left end arms 34*c*, 36*c* are pivotally coupled respectively to the right and left intermediate arms 34*b* and 36*b* by respective hinge means. Similarly, the other ends of each of the right and left intermediate arms 34*b*, 36*b* are respectively coupled to the right and left lead arms 34*a*, 36*a* by hinge means. Each of the aforementioned intermediate and lead arms is free to pivot about the trolley to which it is coupled and from which it is suspended. Thus, displacement of the various trolleys along the length of the I-beam 38 permits the two sets of lead, intermediate, and end arms to be drawn toward or away from the center of an aperture across which the I-beam 38 extends. As show in FIG. 2, a panel 30 extends from and is supported by a respective one of the lead, intermediate, and end arms and is either displaced across the opening or withdrawn from the opening depending upon the displacement and positioning of each of the aforementioned arms. As shown in the figures, the right and left lead arms 34*a* and 36*a* are angled along the length thereof to provide an off-center arrangement to facilitate initial opening of the folding door and displacement of two lead panels along the I-beam 38**.

Figure 4:
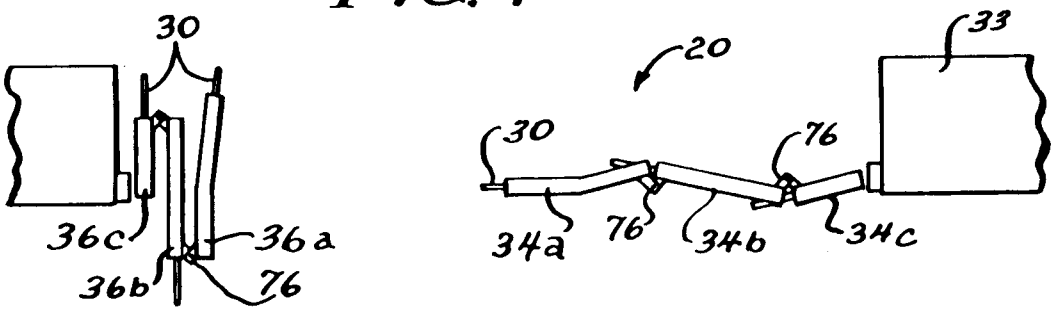
FIG. 4 is a top plan view of the folding door of the present invention showing the right hand section of the door in the closed position and its left hand section in the open position.

Referring to FIG. 4, there is shown a top plan view in simplified schematic diagram form of the folding door 20 of the present invention. While this figure as well as the previously discussed figures show the folding door positioned within the aperture, the present invention also contemplates mounting the side frames of the door to an outer surface of the wall. As shown in FIG. 4, each adjacent pair of arms are pivotally coupled together by means of a respective hinge 76. Also as shown in FIG. 4, each of the panels 30 suspended from a respective one of the aforementioned support arms extends beyond the length of its associated arm. Thus, the width of each of the panels 30 is greater than the length of its associated arm from which it is suspended in order to provide an overlapping panel arrangement when the folding door 20 is in the closed position. FIG. 4 shows the rightmost three panels **34*a*, 34*b* and 34*c* in the closed position across an opening within the wall 33. On the other hand, the three leftmost panels 34*a*, 34*b* and 34*c* are shown in the figure in the fully retracted, or open, position. During normal operation, displacement of the three right-hand panels and the three left-hand panels is coordinated such that both are either in the open or closed positions at the same time. The arrangement of FIG. 4** may be achieved by disconnecting one set of three panels from the drive chain and sprocket arrangement and manually displacing the thus disconnected panels or by providing independent drive arrangements for the right-hand panels and the left-hand panels.

Figure 5:
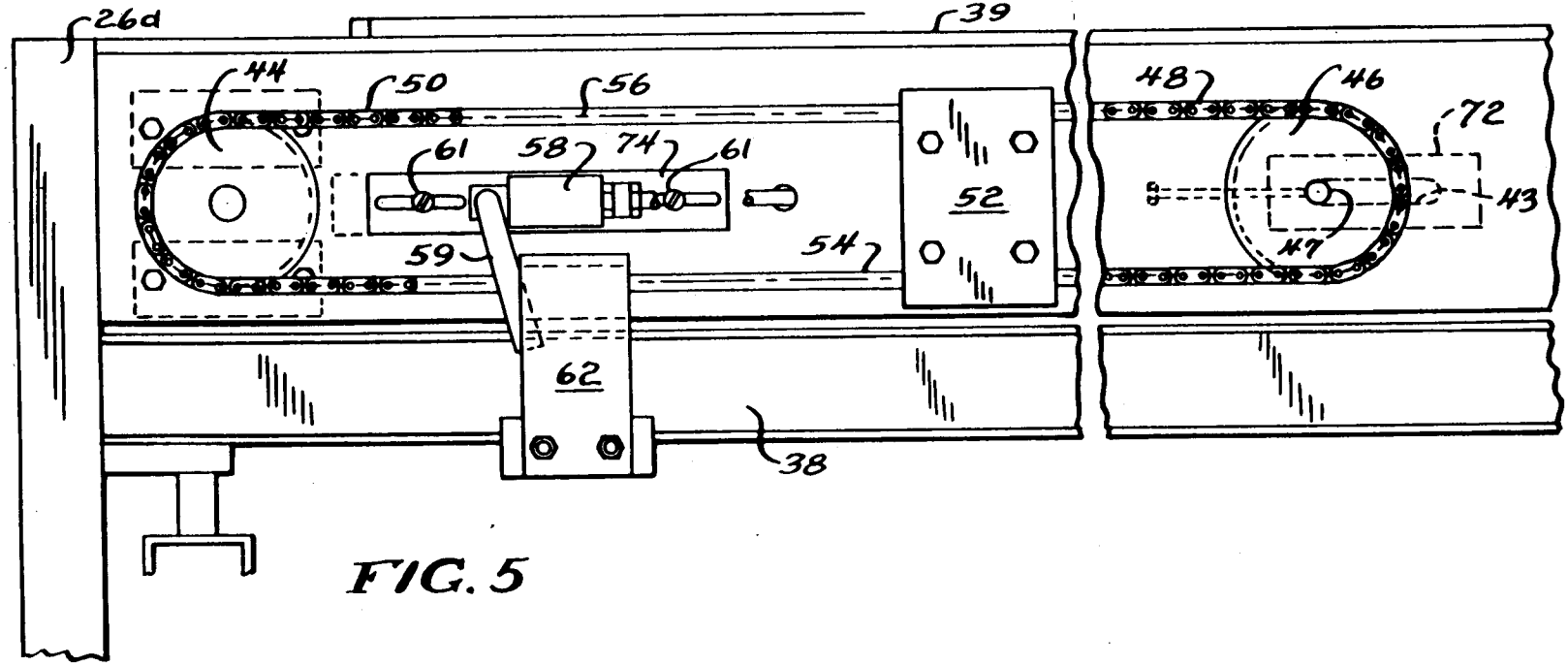
FIG. 5 is a front view of the drive and support arrangement located within the header portion of the folding door of the present invention.

Referring to FIG. 5, there are shown additional details of the drive chain arrangement used to open and close the folding door. Full leftward displacement of the left moving bracket 62 results in its engagement with a trip arm 59 of the open limit switch 58. Pivoting displacement of the trip arm 59 causes the open limit switch 58 to send a full open signal to the drive motor (not shown in FIG. 5) for terminating further outward displacement of the left moving bracket 62. The open limit switch 58 is mounted to a slotted adjustment plate 74 which, in turn, is securely attached to the support beam 39 via a pair of threaded mounting pins 61. The slots within the adjustment plate 74 allow its position along the length of the support beam 39 to be adjusted as desired. This permits the full open position of the folding door to be adjusted as desired along the length of the I-beam 38. A similar mounting arrangement is provided for a close limit switch 60 as shown in FIGS. 2 and 3 to permit the extent of overlap of the two center panels to be fixed as desired when the folding door is closed and the left moving bracket 62 engages the close limit switch. The other end of the support beam 39 is also provided with an elongated slot 43 through which is inserted an idle shaft 47 upon which the idle sprocket 46 is rotationally mounted. The idle shaft 47 is securely maintained in position within the slot 43 by conventional means such as an adjustment block 72. The position of the idle shaft 47 may be fixed along the length of the slot 43 in order to provide a desired tension in the drive chain arrangement illustrated in FIG. 5.

Referring to FIGS. 6 through 10, there are shown various views of an arrangement for supporting and allowing the linear displacement of the various panels 30 of the folding door along the I-beam 38. As shown in FIG. 6, the generally "C"-shaped support beam 39 is disposed immediately above and in contact with the I-beam 38. These two members are disposed within the header assembly 26 and are preferably coupled together along the respective lengths thereof. The header assembly further includes a bottom panel 29, with a slot disposed between the forward edge of the bottom panel and a forward portion of the header assembly 26. The combination of the drive motor 40 and gear box 42 is coupled to an aft portion of the support beam 39 by means of a mounting bracket 33 and mounting bolts. An upper clamp 80 is used to couple the right moving bracket 64 to the upper section of the chain drive arrangement. Similarly, a lower clamp 82 is used to affix the left moving bracket 62 to a lower portion of the drive chain arrangement. A lower end portion of the left moving bracket 62 is coupled to a lateral portion of a trolley 70 disposed upon and supported by the I-beam 38. A similar arrangement for attaching a lower portion of the right moving bracket 64 to the I-beam by means of a trolley is provided for, although the details of this arrangement are not shown in FIG. 6 for simplicity.

The details of the structure and operation of the trolley 70 as shown in the various views of FIG. 6, 8, 9 and 10 will now be described. The trolley includes a generally U-shaped base 84 having facing ends thereof turned inward. The trolley base 84 includes a generally flat center portion from which extend upward in an inclined manner the forward and aft flanges 104 and 106. The terms "forward" and "aft" are used relative to the front and rear of the folding door 20 and its associated header assembly 26. A front main wheel 90 is rotationally mounted to the forward flange 104, while a rear main wheel 92 is rotationally mounted to the aft flange 106 by means of a respective mounting/pivot pin inserted through the flange. Similarly, a first pair of forward side rollers 86 and a second pair of aft side rollers 88 are rotationally mounted to respective front and aft portions of the trolley's base 84. Each of the aforementioned forward and aft side rollers 86, 88 is maintained in position by and rotates about a respective mounting/pivot pin inserted through the trolley's base 84. A retaining pin 108 is inserted through each mounting/pivot pin. Each of the forward and aft main wheels 90 and 92 is adapted to engage and ride upon a lower portion of the I-beam 38. Similarly, each pair of the forward and aft side rollers 86, 88 is adapted to engage a lower, lateral portion of the I-beam 38. The front and rear main wheels 90, 92 thus provide rolling support for the trolley 70 upon the I-beam 38, while the forward and aft pairs of side rollers 86, 88 prevent lateral displacement of the trolley relative to the I-beam. In this manner, the trolley 70 is prevented from becoming misaligned with respect to the I-beam 38 regardless of the direction or magnitude of force imposed upon the trolley. A mounting plate 94 attached to the forward lateral face of the trolley's base 84 includes a pair of mounting bolts 95 to facilitate secure coupling of the trolley to a lower end portion of the left moving bracket 62 as shown in FIG. 6. The various pairs of facing rollers described above provide the trolley with a self-aligning feature by means of which the trolley is more securely and stably mounted to the I-beam 38.

Coupled to a lower portion of the trolley by means of the combination of a nylon bushing 96 and retaining pin 98 is a coupling bracket 100. The retaining pin 98 permits rotational displacement of the coupling bracket 100 about the longitudinal axis of the retaining pin. Similarly, with the nylon bushing 96 inserted from below through an aperture within the coupling bracket 100, the coupling bracket is free to rotate about the nylon bushing as well as about the trolley 70. These two rotational degrees of freedom of the coupling bracket 100 facilitate its rotational displacement as well as that of a folding door panel suspended therefrom about the trolley 70 and support I-beam 38. This freedom to rotate upon lateral displacement of the coupling bracket 100 and support arm to which it is coupled such as in response to displacement of a panel suspended from the support arm due to vehicular impact or wind pressure reduces the possibility of the trolley 70 coming off the I-beam 38 under adverse conditions. Inserted through the coupling bracket 100 and adapted to securely engage a support arm from which a door panel is suspended are a pair of coupling pins 102. As shown in FIG. 6, the coupling pins 102 securely attach the center arm 136 to the coupling bracket 100.

As shown in FIGS. 6 and 7, a lower portion of the center arm **36*a* is provided with a slot extending the length thereof. Similarly, the upper edge of each of the panels 30 is provided with a pair of retaining strips 30*a* on facing surfaces thereof. Each of the panels is attached to its associated support arm by inserting the upper edge of the panel in the support arm's slot and drawing the panel within and along the length of the support arm. With the panel 30 extending through the slot within the support arm 36*a*, the pair of facing retaining strips 30*a* engage an inner portion of the support bar and maintain the panel securely in position therein. A self-tapping screw 78 is inserted through the center arm 36***a* so as to engage an upper edge of the panel 30 and prevent the panel from sliding out one end of the center arm. Other means may be used to maintain the panel 30 securely within its associated support arm.

Each of the panels 30 is comprised of polyvinyl chloride (PVC) sheeting which may be transparent, although other conventional materials may be used for the panels. The retaining strips 30*a* may also be comprised of PVC and attached to the main panel by heat welding, or sealing, in combination with the application of pressure. Another approach for affixing the retaining strips 30*a* to the PVC panel 30 may be by means of a PVC weld bead disposed between the panel and each of the retaining strips and heated to the required temperature to effect adherence. Finally, high strength adhesives may be used to affix the pair of retaining strips 30*a* to the facing surfaces of the panel 30 adjacent the upper edge thereof.

Figure 11:
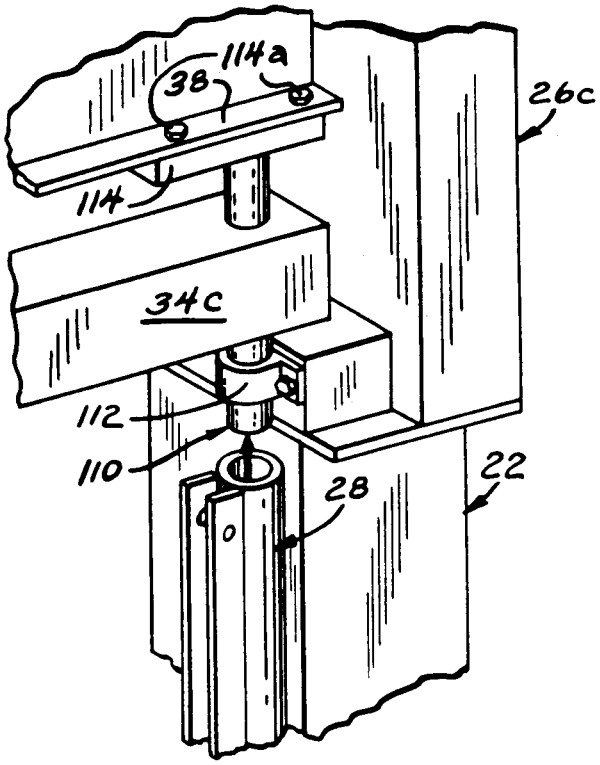
FIG. 11 illustrates the manner in which an upper portion of the folding door is pivotally mounted to a stile.

Referring to FIG. 11, there is shown the manner in which an end support arm 34*c* is attached to a stile 28 which, in turn, is securely mounted to the side frame 22. As shown in FIG. 11, a mounting bracket 114 is attached to a lower, end portion of the I-beam 38. Coupled to and extending downward from the mounting bracket 114 is an arm pivot shaft 110 which is inserted through an aperture within and adjacent to the end of the support arm 34*c*. A lower end of the arm pivot shaft 110 is coupled to the end panel 26*c* by means of an upper pivot bracket 112. The lower end of the arm pivot shaft 110 is further inserted in an aperture in the upper end of the stile 28. The right end panel 26*c* of the header assembly is positioned upon and securely attached to the side frame 22. This mounting arrangement permits the end support arm 34*c* to be freely rotated relative to the side frame 22 about a generally vertical axis through the stile 28. In a preferred embodiment, mounting bracket 114 is provided with a plurality of spaced slots or apertures (not shown) along its length to allow its position along the length of the I-beam 38 to be adjusted as desired by inserting mounting pins 144*a* through a selected pair of slots or apertures. Similarly, the upper pivot bracket 112 is also provided with a plurality of spaced slots or apertures (also not shown) along its length to allow its position along the depth of the end panel 26*c* to be adjusted as desired by inserting mounting pins 112*a* through a selected pair of slots or apertures. By adjusting the position of the mounting bracket 114 along the length of the I-beam 38 and the position of the upper pivot bracket 112 along the depth of the end panel 26*c*, with the lower end of the pivot shaft 110 inserted in the upper end of the stile 28, the support arms from which the trolleys are suspended may be aligned in a plane parallel with the I-beam with the folding door in both the open and closed positions.

Figure 12:
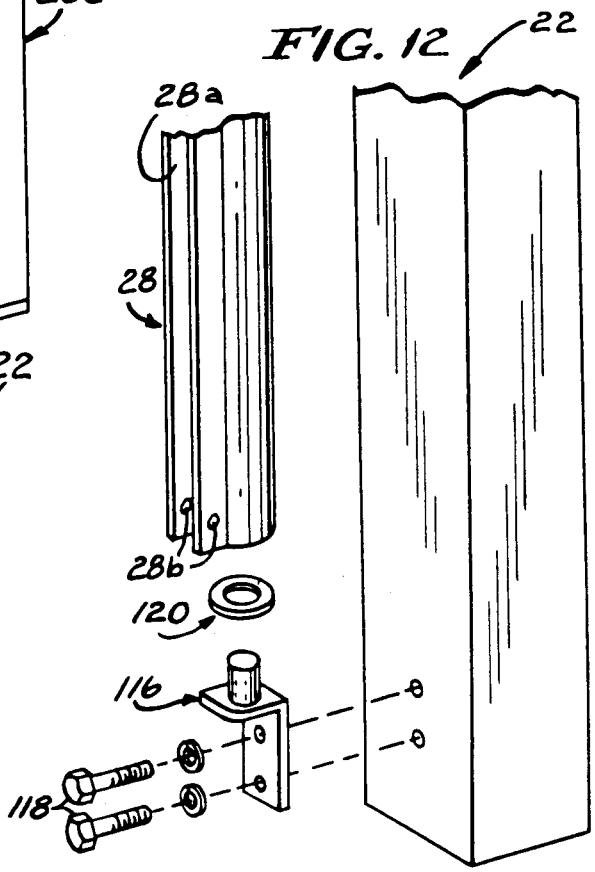
FIG. 12 illustrates the details of the manner in which a lower portion of the folding door is pivotally mounted to a stile.

Referring to FIG. 12, there is shown the manner in which a lower end of the stile 28 is pivotally coupled to an adjacent lower end of the side frame 22 by means of a lower pivot bracket 116. The lower pivot bracket 116 is securely mounted to an inner surface of the stile 22 by means of a pair of threaded mounting pins 118. An upper, cylindrically shaped portion of the lower pivot bracket 116 is adapted for insertion within the lower end of the stile 28. A flat washer 120 disposed between the lower end of the stile 28 and the lower pivot bracket 116 facilitates rotational displacement of the stile with respect to the mounting bracket as well as with respect to the side frame 22. The stile 28 is provided with a slot 28*a* along the length thereof which is adapted to receive an edge of the outermost panel along the length thereof. A plurality of spaced, aligned apertures 28*b* on each side of the slot 28*a* within the stile 28 are each adapted to receive a respective mounting pin for securely attaching a door panel to the stile along the length thereof. This arrangement permits both of the outermost folding door panels as well as their associated end support arms to be rotationally displaced about a generally vertical axis defined by a stile.

Figure 13:
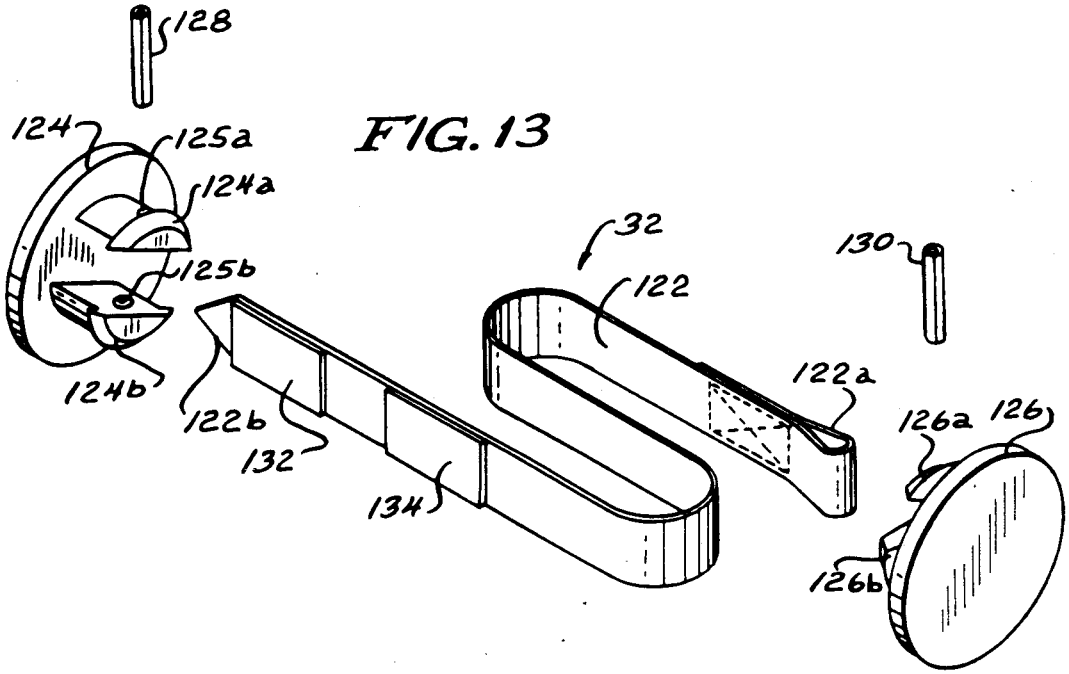
FIG. 13 is an exploded view of a breakaway retaining strap used for coupling adjacent panels in the folding door of the present invention.

Referring to FIG. 13, there is shown the details of a breakaway retaining strap 32 for coupling adjacent panels. The breakaway retaining strap 32 includes first and second end buttons 124 and 126 in combination with a flexible, elongated strap member 122 preferably comprised of a high strength material such as nylon. A first end of the strap member 122 is provided with a loop 122*a*, while a second end 122*b* of the strap member is tapered. Adjacent to the tapered end 122*b* of the strap member 122 is the combination of a Velcro hook portion 132 and a velcro loop portion 134. The second end button 126 is provided with first and second flanges 126*a* and 126*b* having tapered distal ends to facilitate insertion of the end button through a circular aperture within a flexible panel of the folding door. The loop end 122*a* of the strap member 122 is positioned between the flanges 126*a* and 126*b*. A roll pin 130 is then inserted through the flanges 126*a* and 126*b* as well as through the loop end 122*a* of the strap member 122. The roll pin 130 may be of the expansion or split pin type to ensure that the pin is securely retained within the flanges of the end button 126. It is in this manner that the loop end 122*a* of the strap member 122 may be securely coupled to a door panel by means of the second end button 126.

The first end button 124 is similarly provided with a pair of spaced flanges 124*a* and 124*b*, each of which has a beveled distal end to facilitate insertion of the end button through a circular aperture in a door panel. The flanges 124*a*, 124*b* are each provided with a respective aperture 125*a*, 125*b* through which a roll pin 128 may be inserted and securely maintained in position therein. With the roll pin 128 inserted through the apertures 125*a*, 125*b* within the flanges 124*a*, 124*b*, the tapered end 122*b* of the strap member 122 is inserted between the roll pin and the flat portion of the end button 124. The tapered end 122*b* of the strap member 122 is then wrapped around the roll pin 128 permitting the Velcro hook portion 132 and the Velcro loop portion 134 to be positioned in mutual engagement. The first end button 124 is thus coupled to a second end of the strap member 122. The Velcro coupling arrangement at one end of the strap member 122 provides breakaway coupling between adjacent door panels. Thus, upon impact of one or more door panels with a moving vehicle, the breakaway retaining strap 132 separates allowing a pair of adjacent panels to be freely displaced relative to one another and preventing either a severing of the coupling member between the adjacent panels or damage to either of the panels. In addition, prior art panel coupling arrangements of the nonbreakaway type have resulted in large forces being applied not only to the panels, but also to the panel support and displacement structure requiring repair and replacement of the various components in the door's header assembly. The breakaway retaining straps 32 avoid this problem by allowing adjacent, coupled door panels to be easily separated upon impact with a moving vehicle and to be subsequently joined in restoring the integrity of the door without expensive repairs or the replacement of any components.

Figure 14:
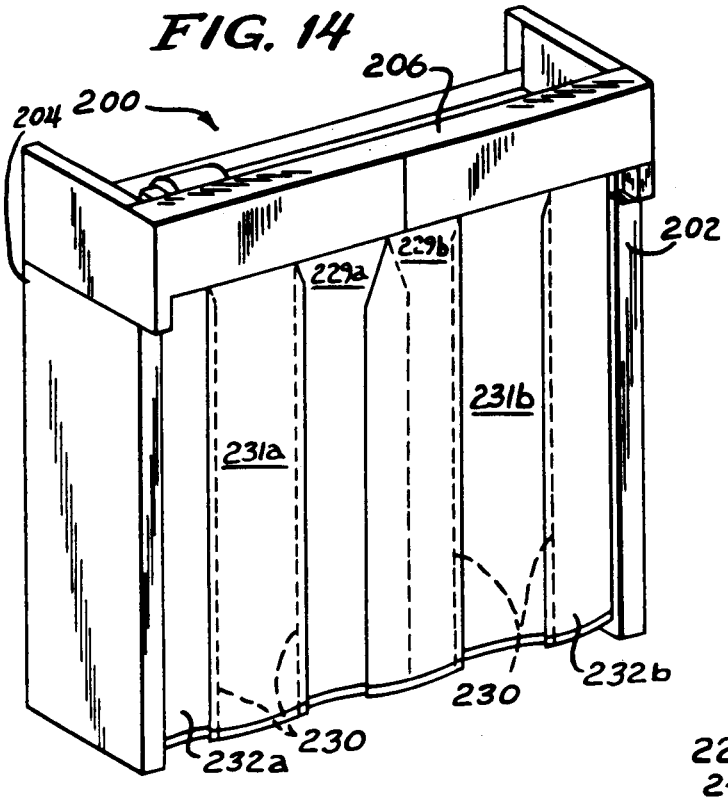
FIG. 14 is an upper, front perspective view of a preferred embodiment of the high speed folding door of the present invention.

Referring to FIG. 14, there is shown an upper, front perspective view of a high speed folding door 200 in accordance with a preferred embodiment of the present invention. As in the earlier described embodiment, the high speed folding door 200 of FIG. 14 includes a right side frame 202, a left side frame 204 and a header assembly 206. Disposed within the header assembly 206 are a plurality of spaced trolley and support arm combinations (not shown) to which an upper edge of each of the panels of the high speed folding door 200 is securely attached as described below. As shown, the folding door 200 includes left inner, intermediate and end, or outer, panels 229*a*, 231*a* and 232*a* as well as right inner, intermediate and end panels 229*b*, 231*b* and 232*b*. The three panels on the right are coupled together as are the three panels on the left as shown in FIG. 14. The three right hand and three left hand sets of panels are laterally displaced toward or away from the right and left side frames 202, 204 by a drive arrangement (not shown) such as previously described for opening and closing the aperture defined by the aforementioned side frames and header assembly 206.

The high speed folding door 200 shown in FIG. 14 which is described in the following paragraphs and illustrated in greater details in FIGS. 15 through 19 is particularly adapted for use where there is an extreme temperature differential between its two surfaces. Such an environment is typically encountered in covering the doorway of a freezer or in very cold climates. Seals are provided for sealing each edge of the door panels either with another adjacent panel or with an adjacent structure for environmentally isolating those areas on the opposite side of the doorway.

Figure 15:
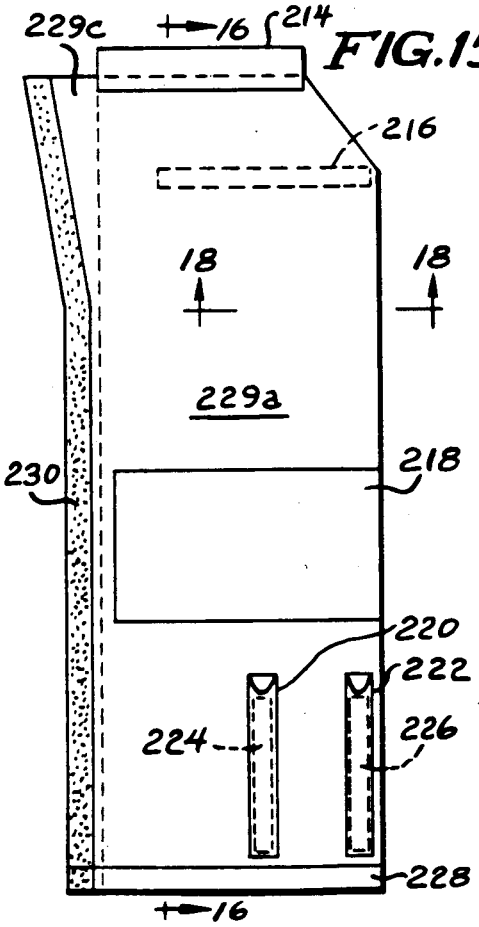
FIG. 15 is a front plan view shown partially in phantom of one of the panels used in the high speed folding door of FIG. 14.
Figure 16:
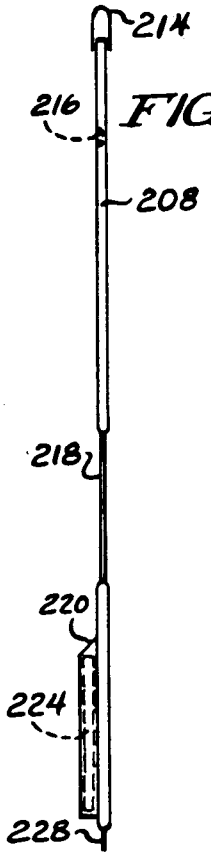
FIG. 16 is a sectional view of the door panel shown in FIG. 15 taken along sight line 16—16 therein.

Referring to FIG. 15, there is shown partially in phantom a plan view of one of the door panels 229*a*. The door panel 229*a* is generally planar and rectangular in shape and is preferably comprised of a multi-layer structure as described below. While the panel herein described in detail is the left inner panel 229*a*, this description is similarly applicable to all of the panels as they differ only in their general shape. Panel 229*a* may include a transparent vision panel 218 positioned therein. The vision panel 218 may be comprised of a low temperature PVC material or a Lexan thermal pane. The latter construction is preferred for the vision panel 218 in that it does not have to be heated to prevent condensation at very low temperatures because of the presence of a vacuum gap disposed between facing Lexan thermal panes in the panel 229*a*. An elongated, semi-rigid reinforcing member 216 which may be comprised of a conventional material such as fiberglass may be positioned within an upper portion of the panel 229*a* for reinforcement. The reinforcing member 216 may be sewn in place between the two facing layers forming the outer skin of the panel 229*a* as described below.

One or more pockets 220, 222 may be attached to an outer surface of the panel 229*a*. Disposed within each of the pockets 220, 222 is a respective weight 224, 226 for maintaining the panel 229*a* in a stretched condition so that it extends from the top to the bottom of the aperture across which the high speed folding door is positioned. Each of the pockets 220, 222 is preferably comprised of a high strength, flexible, impact resistant material such as Hypalon, while virtually any relatively heavy material, or body, may be positioned within the pockets for maintaining the panels in position with a pressure differential across the high speed folding door 200 such as when wind is incident upon the high speed folding door.

Attached to the lower edge of each of the panels is a sweeper strip 228. Each sweeper strip 228 is preferably on the order of two inches wide and is comprised of 35 ounce Neoprene. The sweeper strips 228 seal the bottom of the high speed folding door 200 with the lower surface defining the lower edge of the aperture across which the folding door extends. Attached to the inner edge of each of the outer panels 232*a* and 232*b* as well as to the outer edge of the two inner panels 229*a* and 229*b* is a respective Velcro strip 230. Similarly, both edges of each of the intermediate panels 231*a* and 231*b* are each provided with a respective Velcro strip 230. Thus, with each of the panels arranged in an overlapping manner with an immediately adjacent panel, or panels, each of the panels is coupled along its entire length to an immediately adjacent panel, or panels. Each pair of immediatelly adjacent Velcro strips 230 attached such as by sewing to adjacent panels is comprised of a hook and a loop arrangement for mutual coupling between adjacent edges of the panels. Coupled Velcro strips 230 provide a seal between immediately adjacent panels extending the full length of the panels and allow for separation of adjacent panels upon panel impact such as by a fork lift or other vehicle transiting the aperture across which the high speed folding door extends. Portion 208*a* of the panel 208 to which the Velcro strip 230 is attached such as by sewing is a single layer to facilitate assembly of the panel. The small uninsulated edge portion of the panel 208 does not appreciably affect the high insulating characteristics of the high speed folding door 200 of the present invention. It should be noted that the two inner panels 229*a* and 229*b* overlap when the door is closed but are not coupled together.

Figure 17:
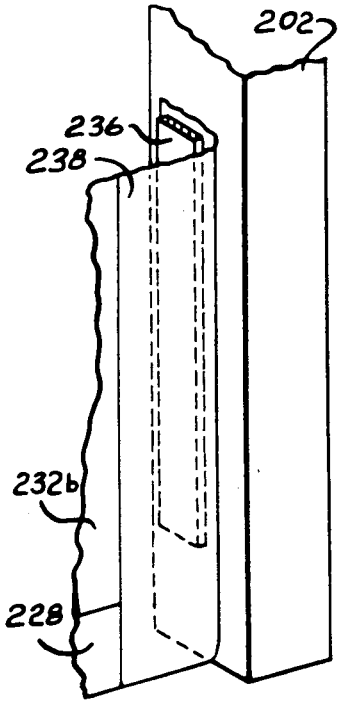
FIG. 17 is a perspective view shown partially in phantom of a lower portion of a continuous, sealed hinge for attaching a side panel of the high speed folding door to an adjacent side frame.

Referring to FIG. 17, there is shown the manner in which one of the outer panels 232*b* is attached in a sealed manner to the right side frame 202. A hinge 238 comprised of a flexible fabric is attached to the outer edge of the end panel 232*a* by conventional means such as heat sealing. The outer edge of the hinge 238, which extends the full length of the end panel 232*b*, is positioned in contact with the right side frame 202 and is maintained attached to the side frame by means of a pressure plate 236 which extends substantially the entire length of the hinge 238. The pressure plate 236 is preferably comprised of a high strength, rigid material such as metal and is securely attached to the outer frame 202 by conventional means such as mounting screws (not shown for simplicity). With one edge of the hinge 238 securely attached to the outer frame 202 and its other edge attached to the end panel 232*b*, as well as to the sweeper strip 228, a continuous leak proof seal is provided at the pivot point of the outer panel. The flexible fabric hinge 238 eliminates the need to fabricate and install a stile with its associated pivoting hardware and substantially simplifies installation and reduces the cost of the high speed folding door of the present invention.

Figure 18:
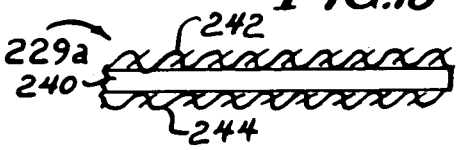
FIG. 18 is a partial sectional view of the high speed folding door panel of FIG. 15 taken along sight line 18—18 therein.

Referring to FIG. 18, there is shown a sectional view of a portion of the panel 229*a* shown in FIG. 15 taken along sight line 18—18 therein. The outer layers 242 and 244 of the panel 229*a* are preferably comprised of a rugged, weather resistant, heavy fabric such as Hypalon. The inner layer 240 may be comprised of virtually any insulating material, with polyethylene bubble pack having a foil laminated to both sides with a minimum thickness of 0.25 inch used in a preferred embodiment. The outer and inner layers should also preferably be comprised of a water vapor-resistant material which does not become excessively rigid at low temperatures. Reflectix TM insulation is used for the flexible insulating core layer 240 in a preferred embodiment.

Figure 19:
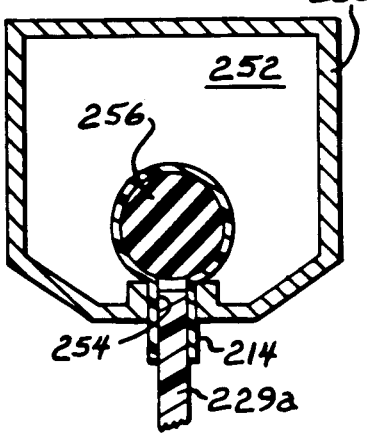
FIG. 19 is a sectional view of an upper edge portion of the high folding door of the present invention illustrating details of the manner in which each of the panels is coupled to and suspended from a respective trolley mounted support arm.

Referring to FIG. 19, there is shown a sectional view illustrating the details in which each of the panels of the high speed folding door of the present invention is suspended and maintained in position within the header assembly. As previously described and as shown in various figures including FIGS. 2, 3, 6 and 7, each of the trolley assemblies has in its lower portion a respective support arm from which one of the panels of the folding door is suspended. As shown in FIG. 19, a support arm 250 is comprised of a generally closed structure having an inner channel 252 therein and a lower slot 254 on a lower surface thereof. Each of the support arms 250 is generally linear and elongated and engages a respective one of the panels adjacent to its upper edge along substantially the entire width thereof. The support arms 250 are preferably comprised of a high strength material such as metal.

Referring back to FIG. 15, each of the panels is provided with a flexible hanger 214 in the form of a loop coupled to its upper edge along the width of the panel as shown in FIG. 19. The flexible hanger 214 may be coupled to its associated panel by conventional means such as by an epoxy cement or by heat sealing. The flexible hanger 214 is preferably comprised of a high strength, flexible fabric and is inserted into the lower slot 254 in the support arm 250 as shown in FIG. 19. An insert preferably in the form of a rubber cord 256 is then positioned within the flexible hanger 214 in a sliding manner in order to maintain the flexible hanger positioned within and coupled to the support arm 250. The flexible hanger 214 and the insert 256 extend over a substantial portion of the width of the panel 229*a*. The combination of the flexible hanger 214 and the rubber cord insert 256 provide the panel 229*a* with a pivoting mounting arrangement to the support arm 250 for reducing the flexing strain on the upper portion of the panel upon impact with a moving vehicle such as a fork lift. By thus reducing the flexing strain exerted on the upper portion of each of the panels, panel usable lifetime is substantially extended and the reliability of the high speed folding door is substantially increased. The flexing advantage of the panel mounting arrangement comprised of the flexible hanger 214 and the rubber cord insert 256 is particularly important in low temperature applications where most conventionally used materials, even low temperature PVC, become extremely brittle and subject to tearing and breakage.

There has thus been shown a high speed folding door comprised of a plurality of coupled, generally vertically oriented flexible panels. Each of the panels is pivotally coupled to and supported by an overhead trolley or pivoting stile-mounted support bar. The trolleys are displaced along the length of an overhead I-beam by means of a motor driven, endless drive chain arrangement which produces rotational as well as linear displacement of each of the door panels in extending and retracting the folding door in an accordion-like manner. The door panel supporting trolleys are self-aligning so as to prevent disengagement of the I-beam by a trolley upon displacement of a door panel by the wind or impact with a moving vehicle. Each flexible door panel is pivotally supended from a trolley to eliminate flexing strain on the panel when impacted which is likely to damage the panel particularly in the case of PVC panels at low temperatures. Adjacent pairs of door panels are coupled in a sealed manner along the lengths thereof by breakaway means which also prevents damage to the door panels when the door is impacted such as by a moving vehicle. Seals are attached to the bottom edges of the panels and to outer edges of the end panels to isolate the areas on respective sides of the door. An insulating intermediate layer may be incorporated in each panel to particularly adapt the door to low temperature applications such as in a freezer.

While particular embodiments of the present invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

I claim:

1. A folding door comprising:

first and second side frames disposed adjacent to respective lateral edges of an opening in a wall;

a header assembly disposed adjacent to an upper edge of and extending across the opening and coupled to respective upper portions of said first and second side frames;

a support structure coupled to and disposed adjacent to said header assembly;

a plurality of trolleys coupled to and suspended from said support structure;

a plurality of support arms each coupled to and suspended from a respective trolley, wherein each of said support arms includes an elongated slot extending the length of said support arm along a lower portion thereof;

a plurality of flexible panels;

a plurality of flexible hanger means for attaching each of said flexible panels to a respective one of said support arms, wherein each of said flexible hanger means is disposed within a support arm and extends through the elongated slot therein and is securely coupled to an upper edge of a flexible panel, and wherein each of said hanger means includes a flexible loop coupled to opposed surfaces of a panel adjacent an upper edge thereof and extending into a support arm through the slot therein, said hanger means further including an elongated member disposed within said support arm and inserted through said flexible loop;

breakaway coupling means for coupling two panels in a sealed, continuous manner along adjacent edges thereof while allowing two coupled panels to be detached from one another when subjected to large forces incident thereon; and drive means coupled to said trolleys for linearly displacing said trolleys along said support structure is opening and closing said folding door.

2. The folding door of claim 1 wherein said flexible loop is comprised of fabric.

3. A folding door comprising:

first and second side frames disposed adjacent to respective lateral edges of an opening in a wall;

a header assembly disposed adjacent to an upper edge of and extending across the opening and coupled to respective upper portions of said first and second side frames;

a support structure coupled to and disposed adjacent to said header assembly;

a plurality of trolleys coupled to and suspended from said support structure;

a plurality of support arms each coupled to and suspended from a respective trolley, wherein each of said support arms includes an elongated slot extending the length of said support arm along a lower portion thereof;

a plurality of flexible panels;

a plurality of flexible hanger means for attaching each of said flexible panels to a respective one of said support arms, wherein each of said flexible hanger means is disposed within a support arm and extends through the elongated slot therein and is securely coupled to an upper edge of a flexible panel, and wherein each of said hanger means includes a flexible loop comprised of fabric and coupled to opposed surfaces of a panel adjacent an upper edge thereof and extending into a support arm through the slot therein, said hanger means further including an elongated member disposed within said support arm and inserted through said flexible loop, and wherein each of said panels is comprised of PVC with each of said flexible fabric loops coupled to its associated panel by heat sealing means;

breakaway coupling means for coupling two panels in a sealed, continuous manner along adjacent edges thereof while allowing two coupled panels to be detached from one another when subjected to large forces incident thereon; and drive means coupled to said trolleys for linearly displacing said trolleys along said support structure in opening and closing said folding door.

4. The folding door of claim 3 wherein said elongated member is comprised of a hard material having a cylindrical shape.

5. The folding door of claim 4 wherein said elongated member is comprised of a hard rubber cord.

6. The folding door of claim 1 wherein adjacent panels are arranged in an edge overlapping manner and wherein said breakaway coupling means includes a pair of complementary, mutually engaging strips each disposed on a respective overlapping edge of adjacent panels.

7. The folding door of claim 6 wherein said strips include a quick release Velcro coupler.

8. The folding door of claim 7 wherein said Velcro coupler strips extend substantially the entire length of a panel.

9. A folding door for use in a high-temperature or low-temperature environment in environmentally isolating areas disposed on respective opposed sides of the folding door, said door comprising:

first and second side frames disposed adjacent to respective lateral edges of an opening in a wall;

a header assembly disposed adjacent to an upper edge of and extending across the opening and coupled to respective upper portions of said first and second side frames;

a support structure coupled to and disposed adjacent to said header assembly;

a plurality of trolleys coupled to and suspended from said support structure;

a plurality of support arms each coupled to and suspended from a respective trolley, wherein each of said support arms includes an elongated slot extending the length of said support arm along a lower portion thereof;

a plurality of flexible panels each having an insulating layer for use in a high or low temperature environment;

flexible mounting means disposed within each of said support arms and extending through a respective slot therein for attaching a panel to a support arm;

quick release coupling means for coupling adjacent panels to one another in a continuous, sealed manner substantially along the entire lengths of said panels; and drive means coupled to said trolleys for linearly displacing said trolleys along said support structure in opening and closing said folding door.

10. The folding door of claim 9 wherein each of said panels includes a pair of facing outer fabric layers and an insulating layer disposed therebetween.

11. The folding door of claim 10 wherein each of said fabric layer is comprised of hypalon.

12. The folding door of claim 10 wherein said insulating layer is comprised of a bubble pack having a reflective foil skin disposed on opposed surfaces thereof.

13. The folding door of claim 12 wherein said bubble pack is comprised of polyethylene and said foil skin is comprised of aluminum.

14. The folding door of claim 9 further comprising a bottom sweep disposed on a bottom edge of each of said panels for sealing a panel bottom edge with a lower portion of the opening in the wall.

15. The folding door of claim 14 wherein each of said bottom sweeps is comprised of a wear resistant material which is sewn to a bottom edge of a panel.

16. A folding door comprising:

first and second side frames disposed adjacent to respective lateral edges of an opening in a wall;

a header assembly disposed adjacent to an upper edge of and extending across the opening and coupled to respective upper portions of said first and second side frames;

a support structure coupled to and disposed adjacent to said header assembly;

a plurality of trolleys coupled to and suspended from said support structure;

a plurality of support arms each coupled to and suspended from a respective trolley, wherein each of said support arms includes an elongated slot extending the length of said support arm along a lower portion thereof;

flexible mounting means disposed within each of said support arms and having a mounting portion extending through a respective slot therein;

a plurality of flexible panels each coupled to and suspended from a respective one of said support arms by said mounting portion of its associated mounting means, said panels including first and second outer panels respectively disposed adjacent to said first and second side frames;

first and second hinge means respectively disposed between and coupling said first outer panel to said first side frame and said second outer panel to said first side frame and said second outer panel to said second side frame and for providing a continuous, flexible seal between each outer panel and its associated side frame;

coupling means for coupling adjacent panels to one another in a continuous, sealed manner along adjacent edges thereof; and drive means coupled to said trolleys for linearly displacing said trolleys along said support structure in opening and closing said folding door.

17. A folding door comprising:

first and second side frames disposed adjacent to respective lateral edges of an opening in a wall;

a header assembly disposed adjacent to an upper edge of and extending across the opening and coupled to respective upper portions of said first and second side frames;

a support structure coupled to and disposed adjacent to said header assembly;

a plurality of trolleys coupled to and suspended from said support structure;

a plurality of support arms each coupled to and suspended from a respective trolley;

a plurality of flexible panels each coupled to and suspended from a respective one of said support arms, said panels including first and second outer panels respectively disposed adjacent to said first and second side frames;

first and second hinge means respectively disposed between and coupling said first outer panel to said first side frame and said second outer panel to said second side frame, each of said first and second hinge means being comprised of a flexible, solid fabric attached to an outer edge of an outer panel and to an adjacent portion of a side frame, said fabric extending substantially the entire length of said panel, providing a continuous, flexible seal between its associated outer panel and its associated side frame;

quick release coupling means for coupling adjacent panels to one another in a continuous, sealed manner along adjacent edges thereof; and drive means coupled to said trolleys for linearly displacing said trolleys along said support structure in opening and closing said folding door.

18. The folding door of claim 17 further comprising first heat sealed coupling means and second coupling means for coupling said fabric to an edge of an outer panel and to an adjacent side frame, respectively.

19. The folding door of claim 18 wherein said second coupling means includes a pressure plate for attaching said fabric to said side frame in a sealed manner substantially along the entire length thereof.

* * * * *

UNITED STATES PATENT AND TRADEMARK OFFICE

CERTIFICATE OF CORRECTION

PATENT NO. : 5,025,846
DATED : June 25, 1991
INVENTOR(S) : Floy D. West

It is certified that error appears in the above-identified patent and that said Letters Patent is hereby corrected as shown below:

Column 6, line 32, delete "show" and insert --shown--.

Column 14, line 64, delete "is" and insert --in--.

Signed and Sealed this

Twelfth Day of January, 1993

*Attest:*

*Attesting Officer*

DOUGLAS B. COMER

*Acting Commissioner of Patents and Trademarks*